United States Patent [19]

Bopst, III

[11] 4,295,921

[45] Oct. 20, 1981

[54] SYSTEM FOR CONTROLLING THE MOVEMENT AND LOCKING OF TAPE APPARATUS

[76] Inventor: John H. Bopst, III, 409 Chalfonte Dr., Baltimore, Md. 21228

[21] Appl. No.: 140,858

[22] Filed: Apr. 16, 1980

[51] Int. Cl.[3] ..... B44C 7/00

[52] U.S. Cl. ..... 156/577; 242/68.4

[58] Field of Search ..... 156/577; 242/68.4, 107.4 R, 242/107.6, 107.7, 107.12; 70/229, 230

[56] References Cited

U.S. PATENT DOCUMENTS

| | | | |
|---|---|---|---|
| 1,253,869 | 1/1918 | Nuckolls | 242/68.4 |
| 1,384,549 | 7/1921 | Augenbraun | 70/230 X |
| 1,967,676 | 7/1934 | Marcher | 242/68.4 X |
| 3,194,509 | 7/1965 | Thompson | 242/68.4 |
| 3,294,339 | 12/1966 | Fontaine | 242/107.4 R |

*Primary Examiner*—David A. Simmons

*Attorney, Agent, or Firm*—John F. McClellan, Sr.

[57] ABSTRACT

An adjustable braking and locking system for tape dispensed from a roll on a spindle mechanism having provision for mounting to a manually manipulable device such as a crack sealer for wall panels includes as part of the spindle a resilient friction-applying subsystem mounting a first end of the roll, a pin and an adjacent thrust limiting axial movement of the second end of the flange, and a sliding-wrenchtype locking mechanism for the friction applying subsystem.

1 Claim, 4 Drawing Figures

FIG. 1
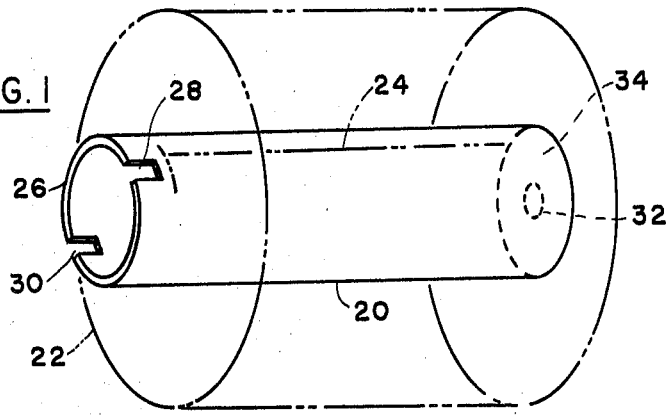
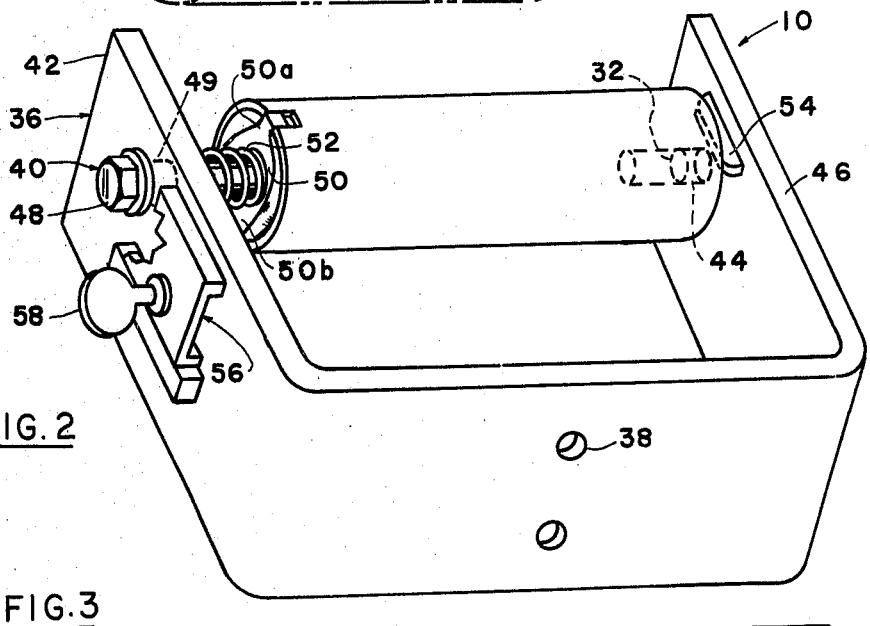
FIG. 2
FIG. 3
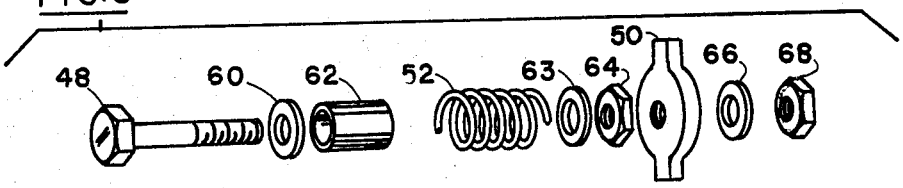
FIG. 4
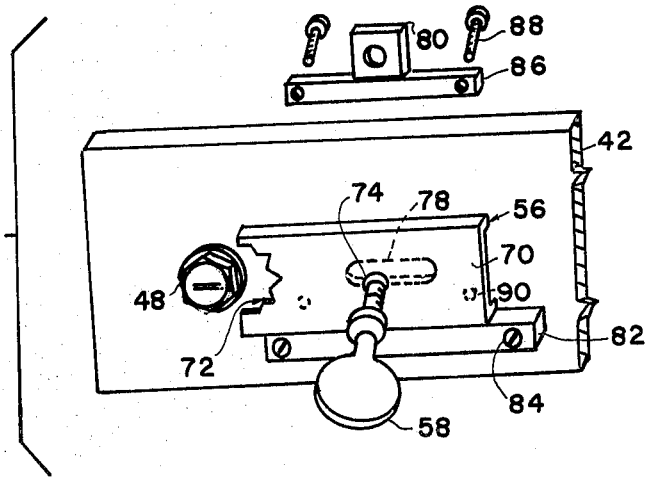

SYSTEM FOR CONTROLLING THE MOVEMENT AND LOCKING OF TAPE APPARATUS

This invention relates generally to reels and specifically to a system for controlling the movement of a tape apparatus and allowing stripping of tape from such apparatus.

In the prior art various web or tape reeling devices have been disclosed including those employing slotted tubes; such tubes and caps for end-closure of tubes are shown, for example, in "Customated Spiral-Wound Products" a catalog of Stone Industrial Division of J. L. Clark Manufacturing Company, 51st Avenue and Cree Lane, College Park, Md. 20740.

The present invention is directed to control of a tape in a manually moved taping device as disclosed in my U.S. Pat. No. 4,174,249 issued Nov. 13, 1979, a heated soleplate being pushed along a crack in a wall and sealing the crack using a thermally sensitive tape unreeled from a spindle on the handle according to my disclosure in that patent.

In such devices the possibility of tape unreeling too much and causing tape flapping exists; control of such is particularly useful in confined areas. When it is necessary to cut the tape, as at the end of a seam, this is easier when the tape is stopped from further unreeling. Also, when the device is not in use it is better to store it with the tape in a stopped or locked position.

Accordingly, principal objects of this invention are to provide a system for controlling the ease of unreeling of a tape from a reel and for stopping the tape from unreeling when desired, in an economical, easy to use and self contained manner.

Further objects are to provide a mechanism as described which is economical, reliable, and durable.

In brief summary given as cursory description only and not as limitation, the invention includes a tape reel mechanism employing a frictional system acting on a positively engaged tubular tape spool.

The above and other objects and advantages of this invention will become more readily apparent on examination of the following description, including the drawings in which like reference numerals refer to like parts.

FIG. 1 is a perspective view of a tape roll;

FIG. 2 is a perspective assembly view of the tape roll and mount for it;

FIG. 3 is a detail of the relation of the tape roll and mount for it; and

FIG. 4 is a perspective exploded detail of the elements of the locking device subassembly shown in a previous Figure.

FIG. 1 shows the spool 20 on which tape 22 (phantom line indication) is stored and unreeled as needed; the inner end of the tape can be secured to the spool as by a line of adhesive 24, if desired. The spool has tubular cylindrical shape. A first end 26 of the spool has at least one and preferably as shown two apertures in the form of slots or notches 28, 30 of uniform width and extending parallel with the axis 180° apart. The second end of the spool is closed except for a coaxial hole 32 substantially smaller than the spool diameter. The closure may be an end cap 34 bonded in place with adhesive or otherwise conventionally affixed and may be flush with the end. The cylindrical portion may be conventionally composed of spiral wound paper plies or may be formed of suitable plastic.

FIG. 2 shows the invention 10 in assembly and ready for operation.

As mounting means a "U"-shaped bracket 36 with two or more mounting holes 38 through the base of the "U"-shape is provided to hold the spool rotatably on a spindle mechanism and to mount it in the apparatus of my previously described U.S. Patent. The "U"-shaped bracket may be of metal or suitable plastic.

The spindle mechanism includes a braking, or rotation-retarding, means 40 detachably engaging the first end of the spool at the first leg 42 of the "U"-shaped bracket and a pin 44 or cylindrical rod, which may be force fitted, projecting as a fixed axle member inwardly from the second leg 46 of the bracket and proportioned for forming a free-running fit with the hole 32 in the second end of the spool.

The braking means 40 includes a screw 48 rotatably mounted in a hole 49 in the first leg of the "U"-shaped bracket. The screw extends inward to threaded connection with a spool-aperture engaging member 50 which has respective integral arms **50*a*, 50*b*** extending in diametrically opposite directions and engaging the respective notches from within the spool. The arms are symmetrical and may be slightly wedge-shaped and proportioned as shown to engage the notch structure tightly, centering the spool. The arms also have a thickness providing considerable overlap with the notches, permitting a degree of axial adjustment relative to the spool.

A compression coil spring 52 coaxially mounted on the screw in the space between the first arm of the bracket and the member 50 supplies resilient frictional force against the surfaces of the first leg of the bracket; the force is adjustable by rotation of the screw relative to the spool engaging member 50. To remove a spool or to insert a fresh spool, the spool is forced against the spool engaging member, causing the spring 52 to compress sufficiently for the spool to clear and engage the pin 44. Fixed inwardly protruding flange 54 on the second leg of the "U"-shaped member adjacent the pin limits spool axial travel and provides constant retarding force braking.

A jam nut prevents relative rotation of screw and spool engaging member when not wanted. A sliding lock assembly 56 grips the hex head of the screw and fixes the screw rotational position when the spool is to be locked in rotation relative to the "U"-shaped bracket. A thumb screw 58 fixes the sliding lock assembly in desired sliding position. Regardless of this locking of rotation, a spool may still be freely removed or inserted into the assembly.

FIG. 3 shows the relations of the axial parts, which provides for adjustment to insure proper tape-flow tension at all times.

First the screw 48 is inserted through washer 60 which has a diameter substantially larger than hole 49 in the left leg of the "U"-shaped bracket, it is inserted through that hole in the left leg of the "U"-shaped bracket, then tubular collar 62 which also has a diameter larger than the hole 49 is slid onto the screw to provide a smooth mounting for the compression coil spring; next the compression coil spring 52 which is substantially longer than the tubular collar is slid over the screw, this is followed by washer 63 to prevent the spring from binding, then jam nut 64 which may be a plain nut is threaded on the screw, next the spool engaging member 50 is threaded on the screw and jammed against jamnut 64, and finally washer 66 is pushed onto the end on the screw and nut 68 is threaded on the screw against washer 66.

Referring now to previously described elements, the spool 20 is assembled by aligning the slots with the arms of the spool engaging member and pushing against them, compressing the spring which is proportioned in length for this, sufficiently for the hole in the second end of the spool to clear the pin 44 fixed in the second leg of the "U"-shaped bracket, at which point the spool is swung on-axis with the pin and released so that the pin goes into hole 32 and the flat of the second end of the spool thrusts against fixed flange 54. Reversing the spool-manipulation steps will remove it. Tightening the screw by screwing it farther into the spool engaging member increases compression on the spring and increases drag of the spring and the washer 60 on the bracket; loosening the screw reduces drag.

FIG. 4 details the sliding lock mechanism 56 for engaging the engagement structure of the screw, which is shown is a conventional hex head, but may be any equivalent shape permitting similar engagement thereof.

This sliding lock is preferably on the outside of the first arm as shown and comprises a rectangular-shape flat strip 70 with a series of wrenching flats in an arcuate array 72 like an open-end wrench proportioned for fitting the polygonal head of the screw, on one end, and with a hole 74 in it through which the shank of slide-locking thumbscrew 58 passes; the shank also passes through a slot 78 in the first leg 42 of the "U"-shaped bracket, and then threads into a nut 80 on the far side of the leg.

The slot is aligned to permit motion of the flat strip with wrench structure on the end in directions away from and against the hex head of the screw to free the hex head and to grasp the hex head, as desired.

A first way 82 is fixed as by screws 84 on the outer surface of the first leg of the bracket in position parallel with the slot to guide the flat strip and prevent it from rotating, and similarly a second way 86 is fixed on the inner surface of the leg in position parallel with the slot and the first way, by screws 88 in tapped holes 90, to guide the nut 80, which may be a square nut, and prevent it from turning.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a tape reel system having a spool for unreeling tape therefrom and means for mounting the spool rotatably, the improvement comprising: the means for mounting including means for adjustably retarding rotation of the spool; means for locking the spool for preventing said rotation of the spool; the means for mounting including a spindle with first and second ends, the spool being cylindrical and having aperture-defining means in the circumference of a first end thereof, the spindle having spool-aperture engaging means adjacent the second end thereof for connecting the spool for rotation therewith; the mounting means further including a bracket comprising a base and first and second arms integral with the base, the means for adjustably retarding rotation including resilient means on the spindle; means for causing the resilient means to exert adjustable force against the first arm including said spool-aperture engaging means having threaded connection with the spindle; the spool aperture defining means defining first and second slots diametrically opposed in said first end of the spool, the aperture engaging means detachably engaging both said slots; the spool having a second end with an end cover thereover having a hole in the center thereof, said means for rotatably mounting the spool, mounting said end cover, by engagement at said hole, to the second arm of the bracket; means for exerting a retarding force on the spool at said second end, comprising a fixed protrusion from the second arm extending against the end cover adjacent the hole; the means for locking including the spindle having a shape permitting engagement of the first end thereof, means on the first arm for engaging said spindle shape, the shape being polygonal and the means on the first arm having an open-end wrench shape proportioned for fitting to said polygonal shape; the means on the first arm having a sliding engagement with the first arm and means for adjustably fixing the sliding position of said sliding engagement; the sliding engagement being on the outside of the first arm and the resilient means comprising a compression spring held on said spindle in a space between said first arm and said spool aperture engaging means; the spindle second end having a closure with a hole therein, means protruding from the second arm into the hole, and means permitting ready removal and reloading of a spool comprising the compression spring having sufficient length to permit a spool to be thrust thereagainst and compress the spring to an extent clearing the second end of the spool from said means protruding.

* * * * *